US005149099A

United States Patent [19]

Radakovich

[11] Patent Number: 5,149,099

[45] Date of Patent: Sep. 22, 1992

[54] GOLF CLUB SWING TRAINING DEVICE AND METHOD

[76] Inventor: Daniel L. Radakovich, 14479 Regency Dr., Strongsville, Ohio 44135

[21] Appl. No.: 822,344

[22] Filed: Jan. 17, 1992

[51] Int. Cl.[5] ..... A63B 69/36

[52] U.S. Cl. ..... 273/189 R; 273/187.2; 482/124; 482/139

[58] Field of Search ..... 273/188 R, 188 A, 189 R, 273/189 A, 190 R, 190 A, 190 B, 190 C, 183 B; 434/252; 482/122, 124, 139

[56] References Cited

U.S. PATENT DOCUMENTS

| | | | |
|---|---|---|---|
| 475,432 | 5/1892 | Blades | 273/189 R X |
| 1,432,013 | 10/1922 | Blake | 482/124 |
| 1,506,631 | 8/1924 | Grover | 482/124 |
| 1,663,641 | 3/1928 | Smallwood | 482/124 |
| 3,677,551 | 7/1972 | Schaus | 273/188 R X |
| 3,740,052 | 6/1973 | Arkin | 273/189 R |
| 4,134,589 | 1/1979 | Arena | 273/188 R X |
| 4,327,909 | 5/1982 | Neufeld | 482/124 |

FOREIGN PATENT DOCUMENTS

| | | | |
|---|---|---|---|
| 165960 | 7/1921 | United Kingdom | 273/188 R |

*Primary Examiner*—George J. Marlo

*Attorney, Agent, or Firm*—Ostrolenk, Faber, Gerb & Soffen

[57] ABSTRACT

A device for facilitating correct swinging of a golf club comprises an elastic loop which is donned over the head of the player with the major portion of the loop resting over the chest, abdomen and on top of the shoulders. The rear of the loop is affixed to the body of the player so that the loop is disposed away from the neck, approximately at the height of the third vertebrae of the back (spine). In play, the handle end of the club is laid inside the elastic loop and pushed downward and outward by the left hand and arm stretching the elastic loop as much as possible. Swinging the golf club against the upward pull exerted by the elastic loop produces the surprising effect of improved control of the golfer's arms which results in a nearly perfect swing plane and levelling and squaring up of the golf club face.

16 Claims, 2 Drawing Sheets

GOLF CLUB SWING TRAINING DEVICE AND METHOD

BACKGROUND OF THE INVENTION

The present invention generally relates to the game of golf and, more particularly, to a device and method of play which facilitate correct swinging of a golf club.

The game of golf is known throughout the world and is presently enjoying a surge in popularity, particularly in certain foreign countries. Golf is considered to be a recreational sport by many, but to the enthusiast or professional, there is a never-ending search for improvements which will attain more perfect and consistent play.

Exemplary prior art includes the device disclosed in Hargraves U.S. Pat. No. 4,781,382 which comprises an attachment which actually touches the golfer's hand to assist him or her in maintaining proper position of the arms. Eddie Birchenough in *Golfing School,* pps. 35–42 has said: "Golf is essentially a game of control . . . Control over the club face . . . is really what the game is all about. The perfect impact situation . . . is when a) the ball is being struck on the 'sweetspot' b) the club head is travelling along the path towards the target and c) the clubface is 'square' to the swing path. Nothing else is needed."

Jerry Barber (PGA champ and Player of the Year—1961) has said: "Control of the hands is the #1 element in the golf swing, and it will always be . . . Really there is no advice that is better." *The Champion's Guide to Golf.* p. 15. It is a tenet of the golf game that control of the swing rests with the left arm. Two things are expected from an efficient golf swing. First, it is desired to attain the greatest club head speed at the instant of impact. Second, it is necessary to bring the club head into the ball squarely along the line of flight. "The function of the whole left side-hand, arm, shoulder, hip, toenails, everything—is to control the club and control the swing all the way up into the backswing and all the way down again until the last few inches before the club face meets the ball." Swarbrick *The Duffer's Guide to Bogey Golf,* p. 56.

Arnold Palmer writes in 495 *Golf Lessons By Arnold Palmer.* p. 44: "The position of the left hand on the club shaft pretty much determines the direction your shots will fly . . . I personally prefer to position this hand so that the back of it faces down the target line. If my club face also faces down the target line at address and impact, I will obtain pretty good direction on my shot if the back of my left hand again looks down the line during impact." And at p. 82 of the same publication he adds "To make a full backswing that will produce a forceful and accurate blow to the ball, your left hand must dominate control of the club."

However, the foregoing is well and fine, but easier said than done, particularly in the case of beginners and amateurs. Accordingly, the present invention aims to enable everyone from the beginner to amateur, and ultimately the professional to improve their skills, whether for recreational or professional tournament play.

SUMMARY OF THE INVENTION

It is, accordingly, an object of the present invention to contribute to a golfer's improvement of alignment, and most important, control of the club face.

It is a further object of the present invention to develop control of a golfer's left arm on which the swing and follow-through are directly dependent.

It is yet another object of the present invention to provide a golfer with an exceedingly simple device for facilitating control and discipline over a golfer's swing plane.

It is yet another object of the present invention to provide a device and a method of play that will assure that the club face is aimed square or 90° to the target line by facilitating the golfer's ability to align the bottom edge of the club face parallel to the ground and so oriented that the force of the swing will be directed precisely along the center line of the club face at impact.

The foregoing and other objects of the present invention are realized by means of an exceedingly simple device in the form of a loop of elastic material which is worn over the head of the player with most of the elastic loop resting normally over the chest and stomach of the player. The elastic loop is fixed at the rear to the clothing or body of the golfer with the rear end of the loop pulled away from the neck of the player. During play, the front, lowermost and hanging portion of the loop is grasped by the left hand thumb and resiliently and elastically extended to reach the handle butt (handle end) of the golf club.

It has been surprisingly discovered that use of the device of the present invention produces greater and almost perfect control and consistency over the club swing. While the scientific principle underlying the invention is not fully appreciated at the present time, it is believed that the pulling force of the elastic loop on the player's arms, away from the club handle, induces and produces muscle "memory" of the position of the extended golfer's arms during the waggle. Consequently, upon execution of the backswing followed by the forward swing, better squaring up (target direction) and ground levelling of the club face at impact and better follow-through to the target are attained. In other words, keeping the hands extended against the elastic pull of the loop, produces, for reasons not fully understood. considerably improved and more precise control over the swing path.

Indeed, by inducing correct and precise control over a player's arms and hands, the present invention yields both improved accuracy, i.e. squaring up and levelling, and more powerful driving resulting from the backswing being with the big muscles of the back and shoulders instead of the arms and hands. The tension applied to the pulling force of the elastic loop creates greater width in the arc of the swing. This produces greater clubhead speed.

Other features and advantages of the present invention will become apparent from the following description of the invention which refers to the accompanying drawings.

DETAILED DESCRIPTION OF THE INVENTION

Figure 1:
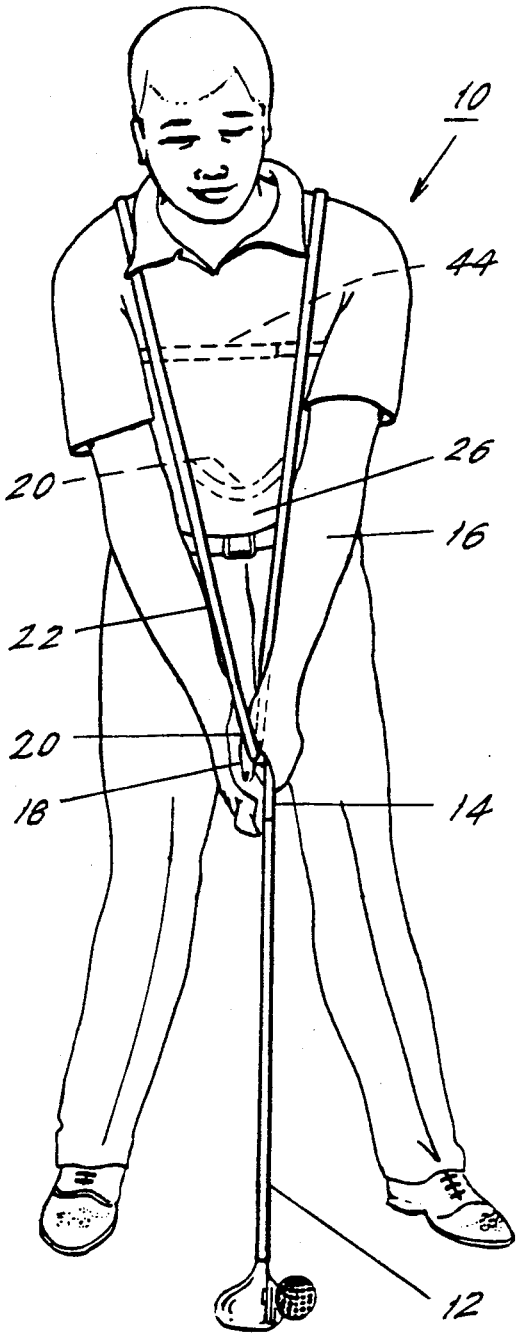
FIG. 1 is a perspective showing a golfer, about to take a swing with the aid of the elastic loop of the present invention.

With reference to FIG. 1, the golfer 10 is shown preparing to take a swing with the club 12 which is laid inside the loop 22, on the front distal end 20 while holding the handle butt 14 with his left arm 16. To obtain a more precise club swing, the player 10 squeezes the front, distal end 20 of the stretched elastic loop 22 between his hands 18 and pushes down and out against the handle 14 of the club, stretching the end 20 of the elastic loop 22 from its relaxed position indicated by numeral 26 (at the abdomen or chest of the player 10) to a position at which the arms of the player are fully extended in preparation for the waggle and swing of the club 12.

Figure 2:
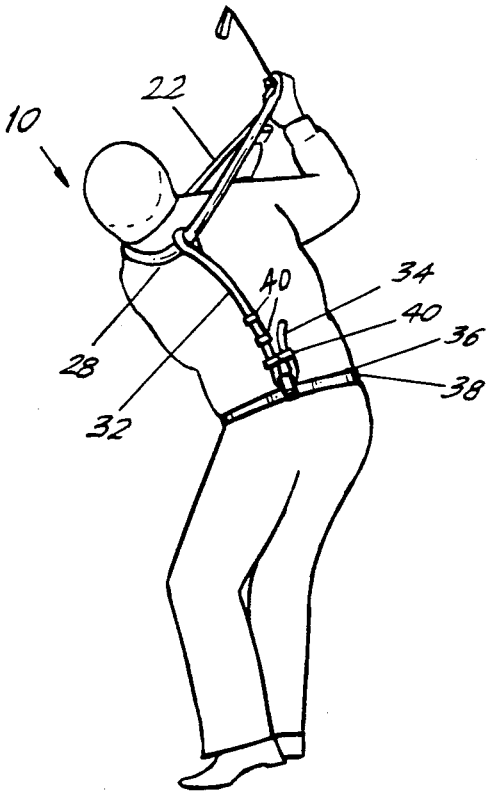
FIG. 2 is a perspective showing a first mode of securing the rear end of the elastic loop at the back of the player.
Figure 3:
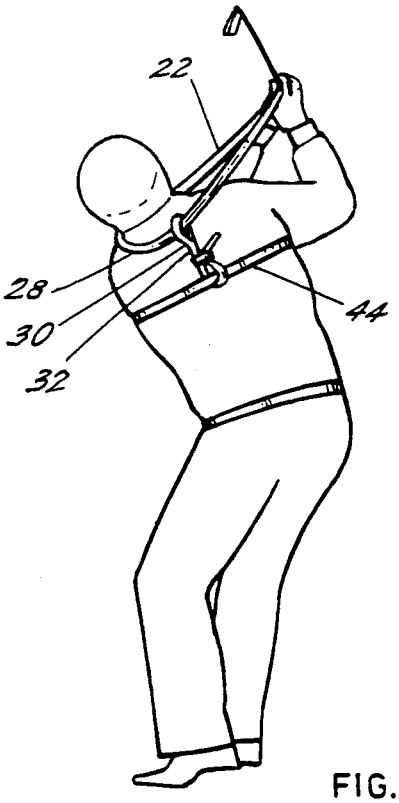
FIG. 3 shows another mode of securing the elastic loop at the back of the player.
Figure 4:
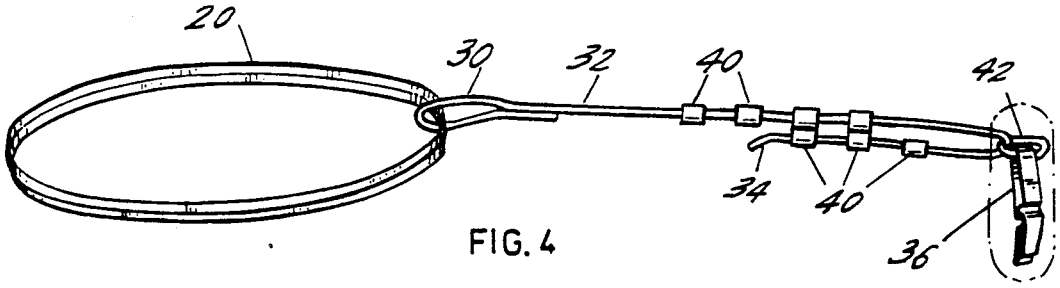
FIG. 4 perspectively shows the elastic loop of the present invention including an elastic holding strap and a pant's clip therefor.

As seen in FIGS. 2–4, a rear distal end 28 of the elastic loop 22 is engaged by a connecting portion 30 of a securing strap 32. A free end 34 of the strap 32 is designed to be slipped through a clasp 36 which can be removably hooked or otherwise secured to the belt or pants 38 of the player 10, as shown. The strap 32 is provided with means to adjust its length, which in FIGS. 2 and 4 is a tie or clamp of double faced Velcro material 40. This permits the connection provided by the tabs 40 to be easily opened to pull on the free end 34 of the strap 32, to thereby adjust the position of the rear distal end 28 of the elastic loop on the back of the player 10.

The inventor herein has discovered that better play is obtained when the rear distal end 28 of the elastic loop 22 is positioned in line with the player's shoulder blades or approximately juxtaposed to the sternum. Further, it is preferred that the strap 32, be fabricated of elastic material so that when the player stretches the elastic loop 22, the force transmitted to the clothing 38 is partially taken up in the strap 32 avoiding uncomfortableness which might otherwise ensue from pulling on the clothing 38. Constructing the strap 32 of elastic material also seems to have a salutary effect on the functionality of the elastic loop 22.

Figure 4A:
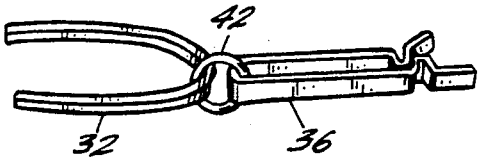
FIG. 4A is an enlargement of the encircled portion of FIG. 4.

While in FIG. 2 the strap 32 is shown slipped directly through the clasp 36, FIGS. 4 and 4A illustrate an embodiment employing a connecting ring 42 between the strap 32 and clasp 36. The clasp 36 of FIG. 4A has a construction which permits it to be easily and blindly connected to the clothing at the rear of the player, solely through the sense of touch. However, the present invention is clearly not limited to the clasp 36 as any type of clasp and other modes of connecting the back of the elastic loop 22 to the body of the player might be used.

Figure 5:
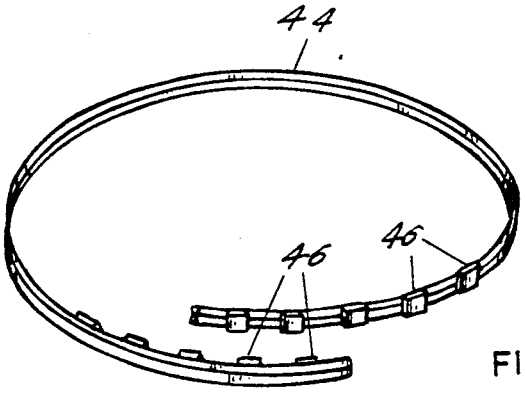
FIG. 5 shows a waist or chest band or belt to which the elastic loop of the present invention can be secured.

With reference to FIGS. 3 and 5, some players might prefer and the present invention accordingly provides a waist belt or chest strap 44 with Velcro tabs 46 for easily donning and removing of the waist belt or chest strap 44 by the player 10 as shown in FIGS. 1 and 3. The waist belt or chest strap 44 is intended to have secured to it the free end of the securing strap 32 as shown in FIG. 3. The waist belt or chest strap 44 may but need not necessarily be constructed of elastic material.

Figure 1A:
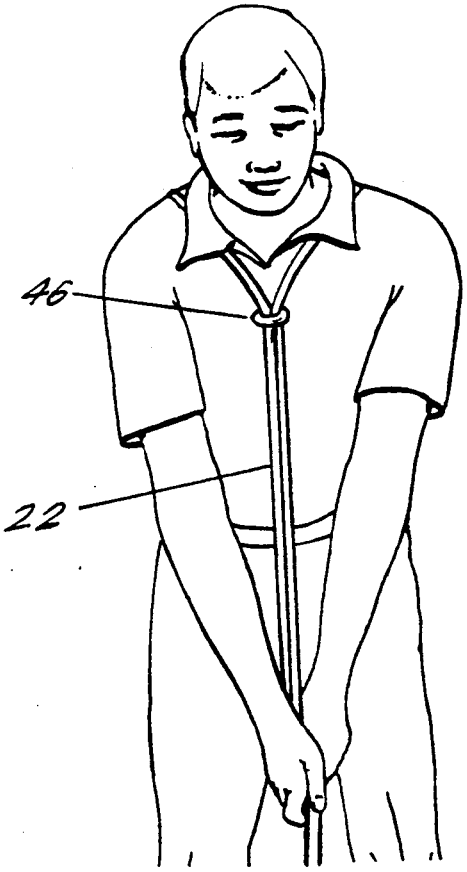
FIG. 1A is generally similar to FIG. 1 and additionally shows a constriction ring which is slipped over the elastic loop of FIG. 1.

FIG. 1A additionally illustrates a small-diameter constriction ring 46 which may slipped over the elastic loop 22 to enable the loop 22 to assume the configuration shown, which may be preferred by some players. This construction ring focuses on the axis of the swing which is between the third vertebrae and sternum of the golfer's spine. This creates centering action of the swing which obviously creates centrifugal force which transposes into greater clubhead speed.

Upon surprisingly discovering the salutary effect on club swing obtained from having the arms of the player restrained by an elastic loop, the inventor herein has tested various materials for constructing the elastic loop 22. He has found that the use of a pair of interconnected latex tubes, of the type used for medical applications, has produced very satisfactory results. However, the elastic loop 22 can be provided and constructed of any type of elastic material which enables the loop to be stretched as shown in FIG. 1 without undue strain on the hands of the player 10. Note that although not illustrated, it is contemplated (but not necessarily preferred) that the elastic loop 22 might have a shape similar to that of the chest strap 44 shown in FIG. 5, to enable adjusting the size thereof to fit different players and to produce a desired pulling force on the arms of the player 10.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A device for facilitating swinging of a playing club, the device comprising:

a loop of elastic material sized to be placed in a relaxed condition over a player's head and rest on a player's shoulder so that a rear distal portion of the elastic loop is disposed approximately at a position of or adjacently below the shoulder blades and a front distal portion of the loop is disposed at a first position approximately between the player's chest and abdomen;

a connecting strap secured to the elastic loop at the rear distal portion of the elastic loop; and means for securing the strap to the body of a player so that the loop may be stretched from said first position;

said elastic loop having a coefficient of elasticity which enables the loop to be stretched by the hand of the player pushing against the front distal portion of the loop while gripping the handle of the club so as to stretch the elastic loop from said first position to a second position in which the arms of a player are fully outstretched while holding onto the loop and a handle end of the club.

2. The device of claim 1, wherein said connecting strap is constructed of elastic material.

3. The device of claim 1, the securing means including a clasp effective for being secured to the clothing of the player.

4. The device of claim 3, wherein the strap includes means for adjusting the length of the connecting strap.

5. The device of claim 4, wherein the means for adjusting the length of the connecting strap comprises a clamp or clasp of double faced interlocking fabric material.

6. The device of claim 1, wherein the securing means includes a waist belt or chest strap comprising a strip of material capable of being worn about the waist or chest of the player, the connecting strap being securable to the waist or chest strap.

7. The device of claim 6, wherein the waist or chest strap is comprised of resilient material.

8. The device of claim 1, further comprising a constriction ring placeable over the front portion of the elastic loop.

9. The device of claim 1, wherein the playing club is a golf club.

10. The device of claim 1, wherein the elasticity of said loop is sufficient to create dynamic tension helping to build muscle strength in hands, forearms and shoulders.

11. A method of swinging a playing club, comprising the steps of:

providing a device including a loop of elastic material and donning the device over a player's head so that a rear distal portion of the elastic loop is disposed away from the neck of the player, the device including a front portion with a front distal end, a connecting strap secured to the elastic loop at the rear distal end of the elastic loop, and securing means for securing the strap to the body of the player;

grasping the front distal end of the elastic loop with at least one hand of the player and stretching the elastic loop to lay the handle butt of the playing club inside the loop;

grasping the handle butt of the playing club with the player's hand; and swinging the club while pressing the club handle onto the distal end of the elastic loop.

12. The method of claim 11, wherein said connecting strap is constructed of elastic material.

13. The method of claim 11, wherein the securing means includes a clasp that is effective for being secured to the clothing of the player.

14. The method of claim 13, further including means for adjusting the length of the connecting strap.

15. The device of claim 11, further including donning a waist or chest strap about the waist or chest of the player and securing the connecting strap to the waist or chest strap.

16. The method of claim 11, wherein the playing club is a golf club.

* * * * *